US006283792B1

(12) United States Patent
Tolmie et al.

(10) Patent No.: US 6,283,792 B1
(45) Date of Patent: Sep. 4, 2001

(54) EXTRUDED METALLIC ELECTRICAL CONNECTOR ASSEMBLY AND METHOD OF PRODUCING SAME

(76) Inventors: Bernard R. Tolmie; Robert H. Wittemeyer, both of 204 Brand Farm Dr., S. Burlington, VT (US) 05403

( * ) Notice: Subject to any disclaimer, the term of this patent is extended or adjusted under 35 U.S.C. 154(b) by 0 days.

(21) Appl. No.: 09/614,171

(22) Filed: Jul. 11, 2000

(51) Int. Cl.[7] ..... H01R 13/648
(52) U.S. Cl. ..... 439/608; 439/108; 439/701
(58) Field of Search ..... 439/608, 108, 439/701

(56) References Cited

U.S. PATENT DOCUMENTS 5,162,001 * 11/1992 Harwath et al. ..... 439/608
5,346,412 * 9/1994 Fedder et al. ..... 439/701
5,460,533 * 10/1995 Broeksteeg et al. ..... 439/608
5,518,422 * 5/1996 Zell et al. ..... 439/608
5,632,625 * 5/1997 Vanbesien et al. ..... 439/108
5,664,968 * 9/1997 Mickievicz ..... 439/608
5,741,144 * 4/1998 Elco et al. ..... 439/108
5,924,899 * 7/1999 Paagman ..... 439/701
6,083,047 * 7/2000 Paagman ..... 439/608
6,132,255 * 10/2000 Verhoeven ..... 439/608

* cited by examiner

*Primary Examiner*—Brian Sircus
*Assistant Examiner*—Hae Moon Hyeon

(57) ABSTRACT

This invention relates generally to an extruded metal rectangular electrical connector housing making a novel electrical connector module configuration having a plurality of contacts in densities of two millimeter (2 mm) on center or less. The rectangular connector has a plurality of contacts with each contact being enclosed in a metal shield along the contact length. The assembly has a rectangular metallic housing that contains a plurality of contact channels through which the contacts are inserted. The contacts are insulated by a coating positioned on the inside of the housing. The contacts are connected to an intermediate printed circuit board. The housing assemblies are stackable because of their shape. A method of producing the extruded metallic electrical connector assembly is also disclosed.

7 Claims, 6 Drawing Sheets

EXTRUDED METALLIC ELECTRICAL CONNECTOR ASSEMBLY AND METHOD OF PRODUCING SAME

BACKGROUND OF THE INVENTION

This invention pertains to electrical connectors, and in particular, to an extruded metallic electrical connector assembly which has a unique module configuration having a plurality of contacts in densities of two mm or less and providing complete insulation coverage for the contacts. A method of producing an extruded metallic electrical connector assembly is also disclosed.

Electrical connectors are used in many different types of electrical and electronic systems. They come in various sizes depending on the physical and electrical parameter of the installation. Some high-speed digital signal applications require multiple contact connectors in a single rectangular module that are held together and stackable without distorting or adversely modifying the signal intelligence. Digital signals must have a high degree of signal integrity on entering and exiting an electrical connector system. Requirements for connector types, in increasingly high speed applications include a high degree of shielding, preventing signal distortion from outside Electromagnetic Interference (EMI) and low inductance and resistance for signal and return signal paths.

Rectangular connectors with multiple contacts that are 2 (two) mm or less in center spacing have limits in contact density and signal shielding by currently employed manufacturing processes. However, electronic systems that use high-speed connectors continue to shrink in physical size and require increasing signal density reducing physical size requirements for connectors. Current rectangular connectors having a plurality of contacts have limits in providing dense signal packaging and shielding of each individual contact within the connector-housing module.

Although classical round coaxial connectors have contiguous shielding along the contact length and provide low inductance and good signal integrity, they do not offer the plurality of contacts in the densities of two mm or less in a rectangular configuration. In round coaxial connections multiple contiguous contacts cannot be densely packed or stacked in a module form to densities attainable in a rectangular configuration. Connectors of a rectangular shape, having a plurality of contacts 2 mm or less for high-speed signal application, use a combination of injection molded plastics either riveted or press fitted to metal plates to simulate shielding and reduce inductance and resistance to improve signal integrity. However, these connector systems, while providing greater contact densities than round coaxial connectors, do not provide a contiguous metal cavity along the length of each individual contact. Instead only one or two sides of each individual contact has a shield vs. all 4 sides of the extruded connector-housing module described here.

U.S. Pat. Nos. 5,176,538 and 4,846,727 try to achieve a metal housing enclosure for connectors having a plurality of contacts by combining injection molded plastic pieces with metal plates added on the assembly to provide a simulated shielding configuration for the signal pin. Neither of these patents encloses each contact pin along four sides of the contact pin length and thus compromise the shielding of the individual contact pins. These connectors are limited by using traditional construction methods in signal pin density for rectangular connector modules having a plurality of contacts with contact spacing of 2 mm or less. Limits in material thickness and process controls used in assembling the connector module (injection molding, metal- stamping, press fitting etc.) limit four sided shielded density. Each contact in these multiple contact connectors is surrounded by injection molded plastic and the entire assembly or module is then fitted with metal plates on one or two sides of the assembly to provide shielding only on one or two sides of the connector-housing module.

Other contemporary U.S. Pat. Nos. 4,451,107 and 4,655,518 are also limited in creating a low inductance and low resistance path to ground. U.S. Pat. No. 4,451,107 is a die cast zinc housing to provide grounds and shields for the signals. However zinc die cast material has higher electrical resistance and inductance path then other materials like copper or copper alloy and has limits in material thickness for contact spacings on 2 mm or less.

U.S. Pat. No. 4,655,518 employs ground contacts located on the outside of the parallel casing. Neither of these patents form the low inductance and resistance path to ground afforded by a contiguous metal module that shields individual contact on all four sides in the housing module. What is needed is a multiple cavity extruded metallic electrical connector assembly that provides complete shielding for each cavity housing an electrical contact that is simple to manufacture. It is the object of this invention to teach an extruded metallic electrical connector assembly that avoids the disadvantages and limitations, recited above in other electrical connector assemblies for contact spacing on 2 mm or less.

SUMMARY OF THE INVENTION

It is the object of this invention to teach a extruded metallic electrical connector assembly, for use in situations requiring electrical connector contacts having a density of two mm on center (i.e., as measured between the center of adjacent electrical contacts or channels) or less and, at the same time, having each of the contacts be completely shielded on four sides, comprising a housing; said housing having a plurality of channels positioned therein; a contact being positioned within each of channels within said housing; guide means positioned at one end of said housing for directing said contacts into said channels within said housing; at least one intermediate printed circuit board; said intermediate circuit board having receiving slots positioned therein for receiving each of said contacts on one end and a means of connecting an electrical cable on the other end comprising a cable assembly; said intermediate printed circuit board further having grounding means attached for providing a ground for said housing; and means for supporting and positioning said electrical contacts.

It is also the object of this invention to teach an extruded metallic electrical connector assembly, for use in situations requiring electrical connector contacts having an density of two mm on center or less and, at the same time, having each or the contacts be completely shielded, comprising a housing; said housing having at least one channel positioned therein; a plurality of conductors being positioned within each of channels within said housing; guide means positioned at one end of said housing for directing said conductors into said channels within said housing; at least one electronic printed circuit board or mother board; said electronic circuit board having receiving slots positioned therein on one end for receiving each of said plurality of conductors and, on the other end, is mounted to said circuit or mother board on the other end; said electronic printed circuit board further having grounding means attached for providing a ground for said conductors; and means for supporting and positioning said electrical contacts.

Finally, it is the object of this invention to teach a method of producing an extruded metallic electrical connector assembly, for use in situations requiring electrical connector contacts having an density of two mm on center or less and, at the same time, having each or the contacts be completely shielded, comprising the steps of extruding a continuous metal housing having a plurality of channels positioned therein; cutting said housing to the desired length; coating the inside of said channels of said metal housing with an insulation material; installing the mating guides; installing the printed circuit board into said housing; terminating cable to the printed circuit board assembly; welding the assembly to the housing.

BRIEF DESCRIPTION OF THE DRAWINGS

Further objects and features of this invention will become more apparent by reference to the following description taken in conjunction with the following figures, in which.

DESCRIPTION OF THE PREFERRED EMBODIMENTS

Figure 1:
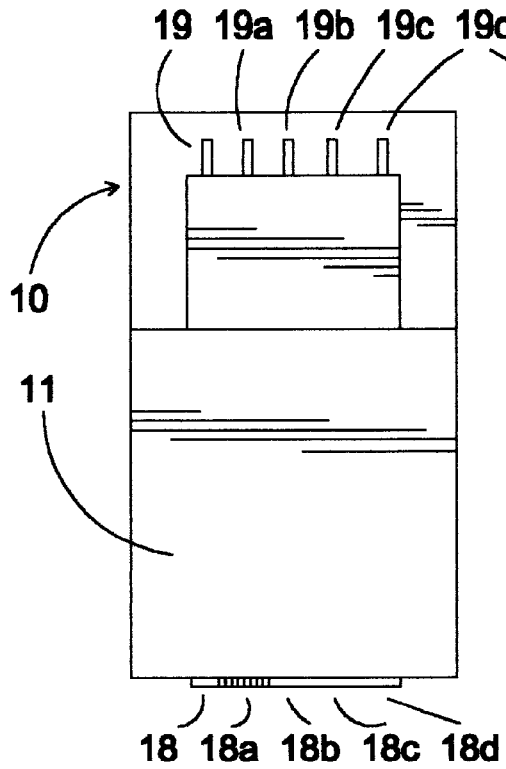
FIG. 1 is a top plan view of the novel extruded metallic connector assembly connected to an electrical cable.
Figure 2:
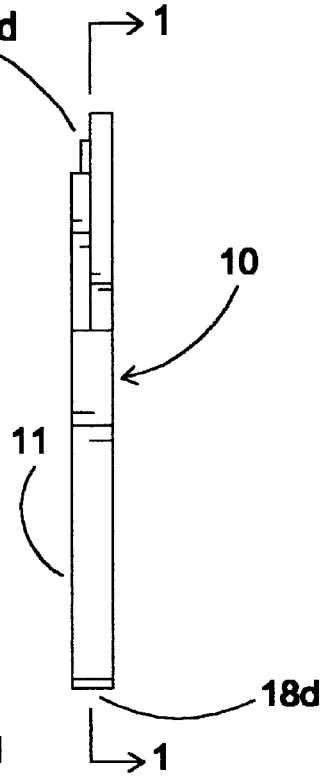
FIG. 2 is a side elevational view thereof.
Figure 3:
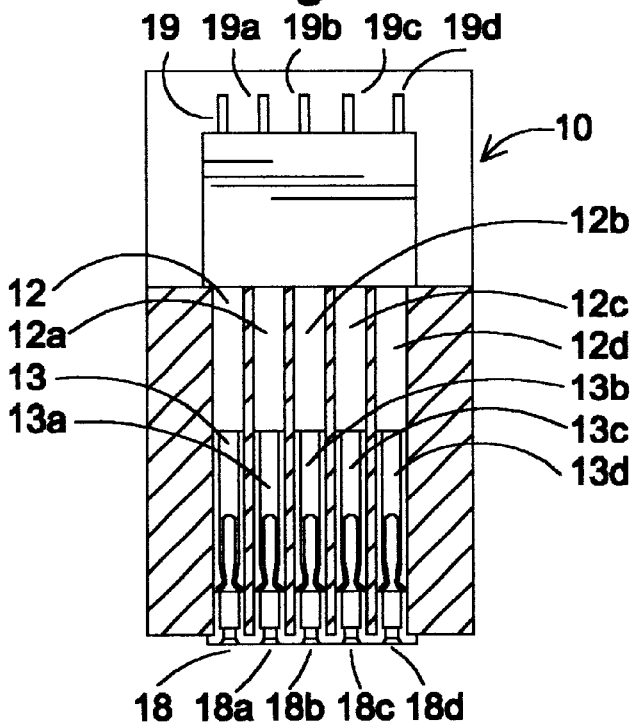
FIG. 3 is a cross sectional view taken along line 1—1 of FIG. 2.
Figure 4:
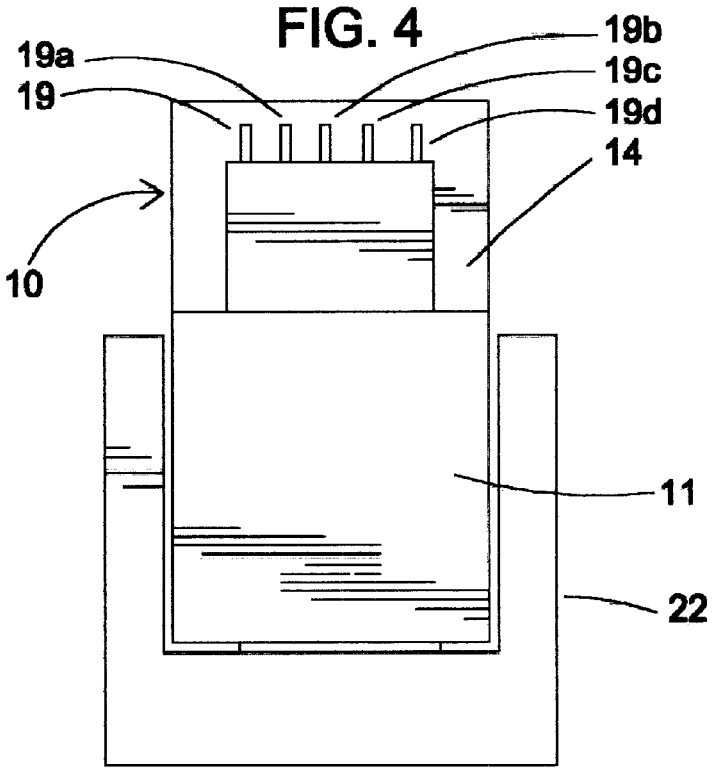
FIG. 4 is a frontal elevational view of connector assembly for mounting to an electrical cable.
Figure 6:
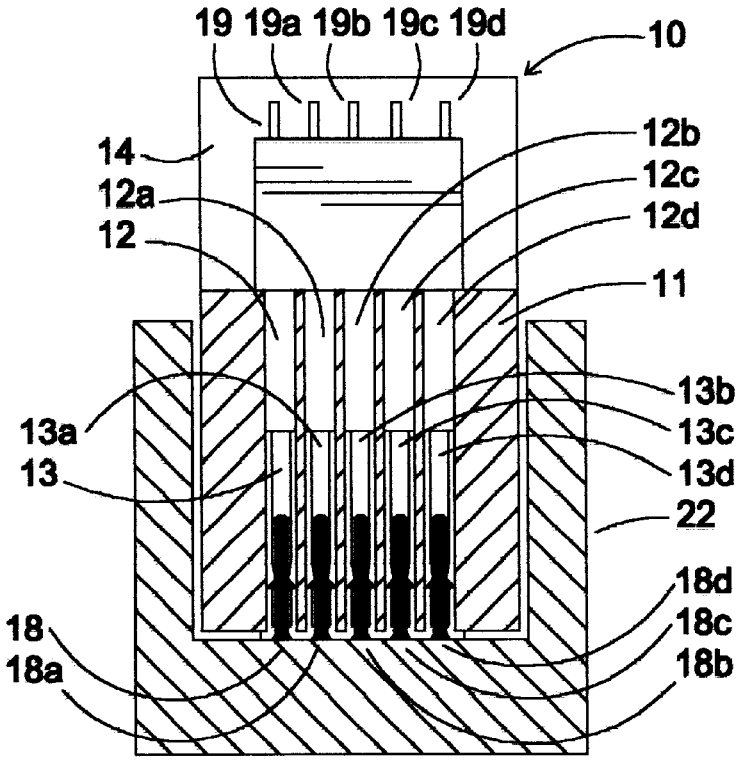
FIG. 6 is a cross-sectional view taken along line 6—6 of FIG. 5 showing the underside mounted to a mating connector receptacle.
Figure 5:
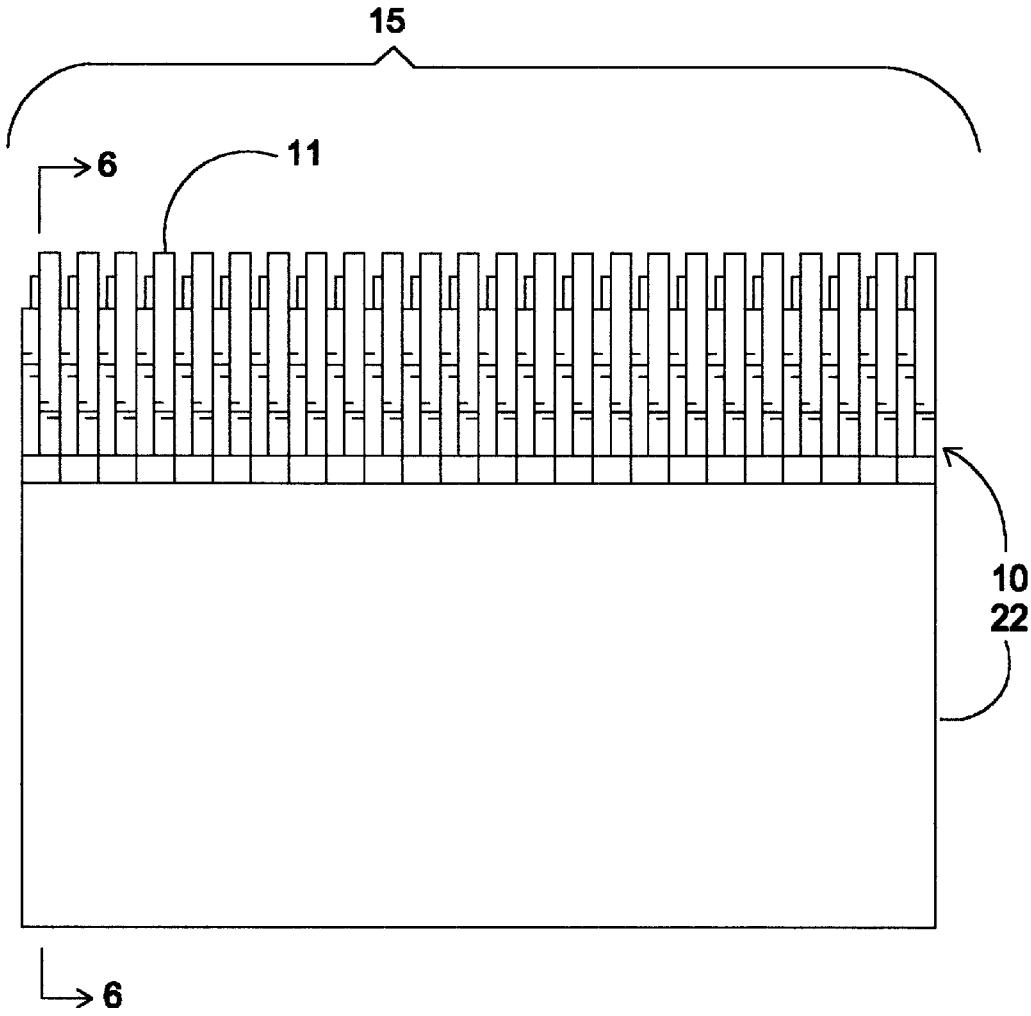
FIG. 5 is a side elevational view of the stacked and mated view of connector assemblies for mounting to an electrical cable.
Figure 7:
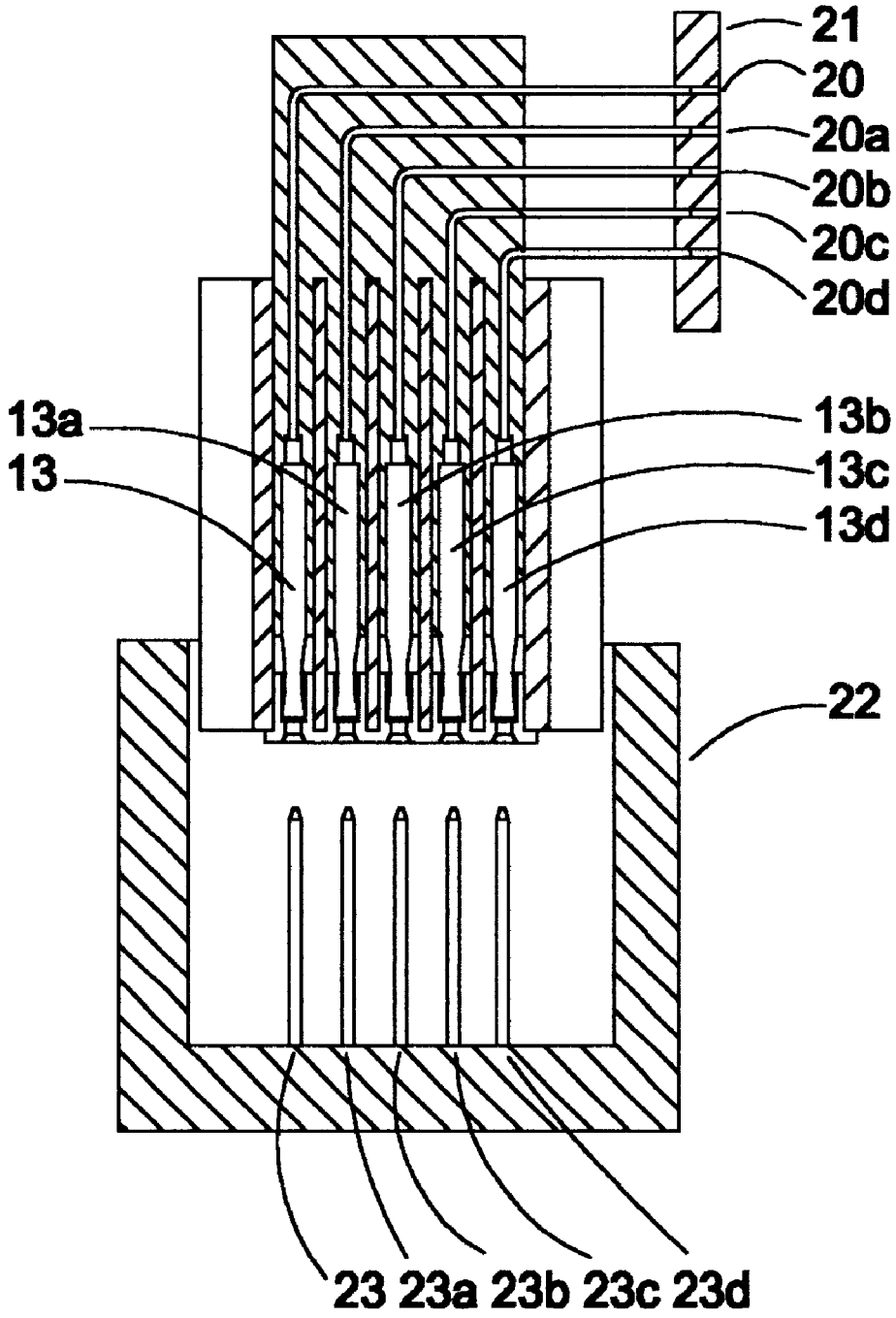
FIG. 7 is a cross sectional view showing the underside mounted to a motherboard.
Figure 9:
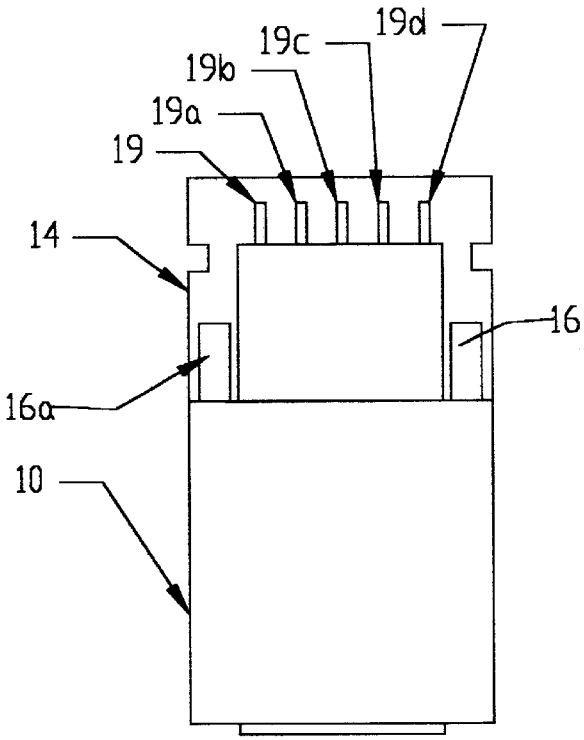
FIG. 9 is a side view of FIG. 8 showing the ground contact tension points.
Figure 8:
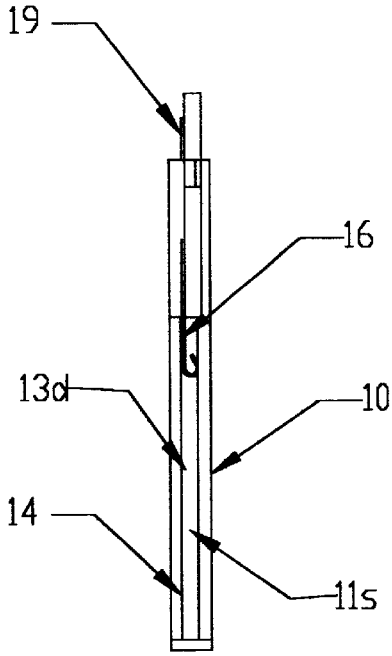
FIG. 8 is a top plan view showing the connector assembly for mounting to an electrical cable.
Figure 11:
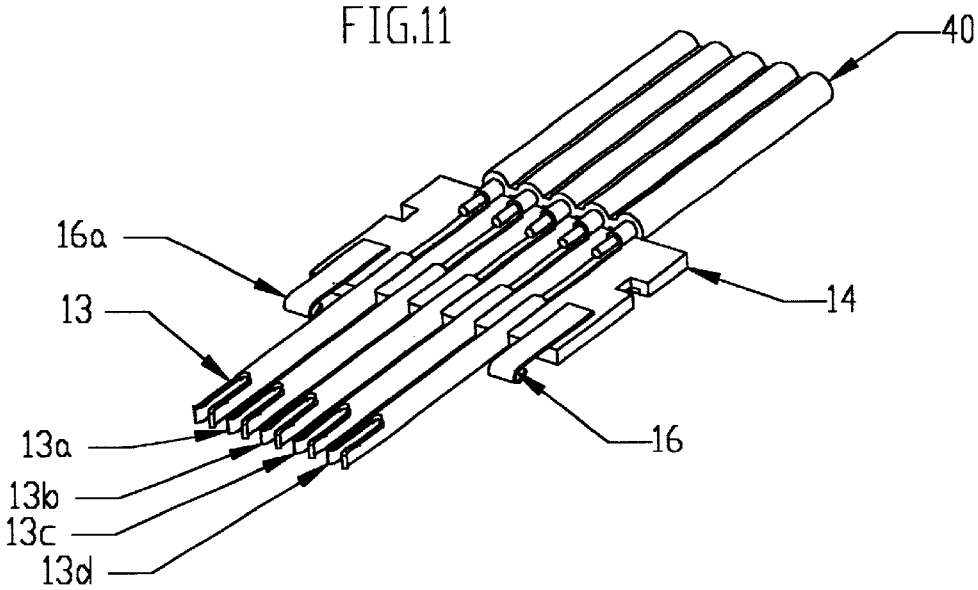
FIG. 11 is a perspective view showing the intermediate printed circuit board and contact point assembly.
Figure 10:
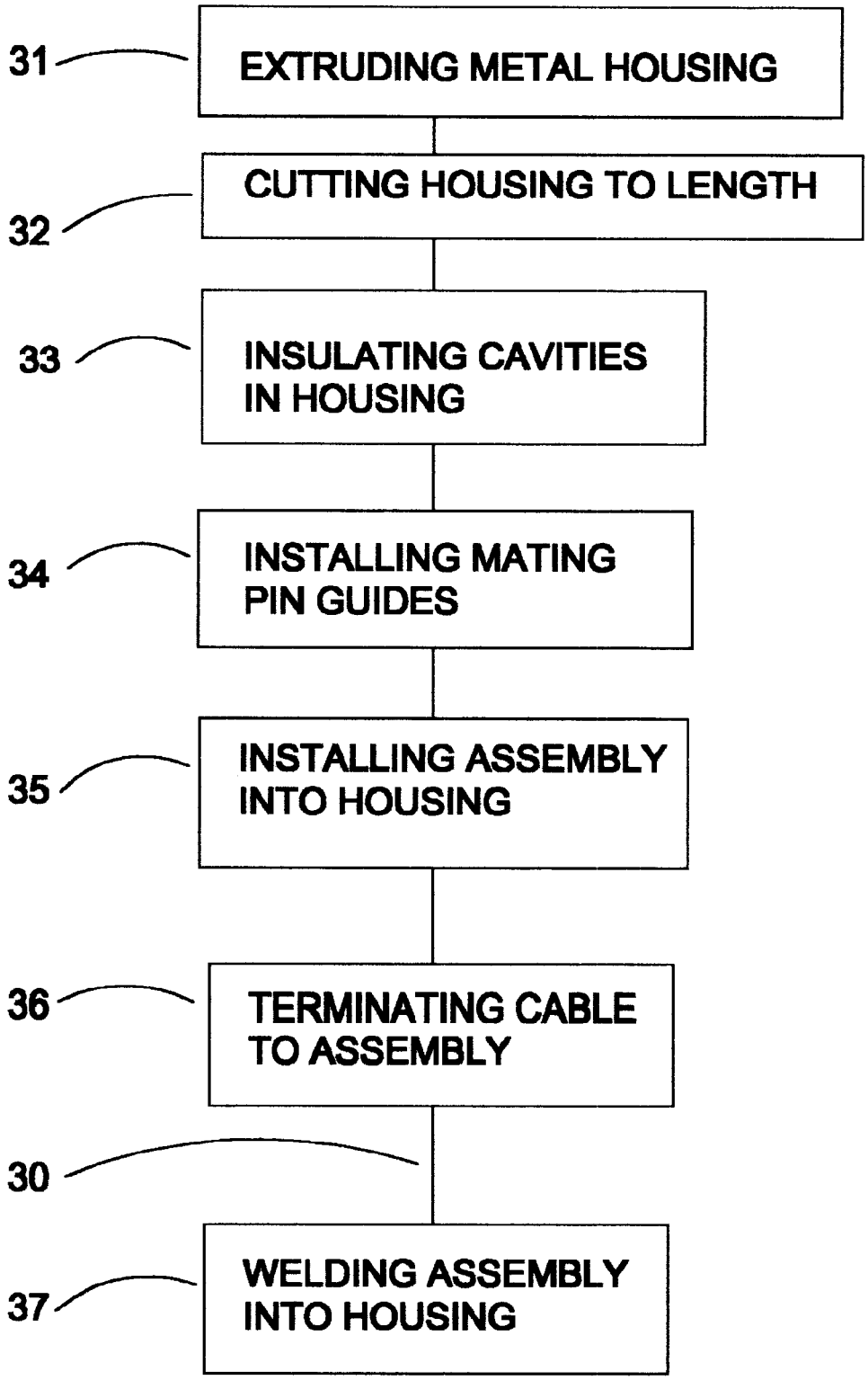
FIG. 10 is a block diagram of the novel method of producing an extruded metallic electrical connector assembly.

As shown in the figures, the extruded metallic electrical connector assembly 10 provides a four sided metal enclosure along the contact length of individual contacts for high density low inductance, resistance and good signal integrity. This means and method of shielding each individual contact along the contact's length by the connector housing 11 extruded from contiguous metal to form individual channels 12, 12*a*, 12*b*, 12*c* and 12*d* to house each contact providing multiple cavities on centers of 2 (two) mm or less. The interior of the channels are insulated from an inserted electrical contact by coating the interior of each channel wall with an insulation material having good dielectric properties for the signal transmission and contact insulation. Contact pins 13–13*d* are inserted into channels 12–12*d* (also referred to herein as cavities), guided by mating guides 18–18*d*. The latter are positioned at the mating end of housing 11 (opposite the end where IPCB 14 is connected) and are inserted into the housing by a press-fit or an adhesive (see FIGS. 1 and 3). Intermediate printed circuit board 14 includes solder tails 19, 19*a*, 19*b*, 19*c* and 19*d* or a board press-fit 20*a*, 20*b*, 20*c* and 20*d* that allow a cable or another printed circuit board to be attached to circuit board 14 (FIG. 7). The pin can then be directly mounted to a intermediate printed circuit (IPCB) board 14 making up part of the connector assembly 10 for termination to an electrical cable assembly or printed circuit board (motherboard) 21. The IPCB 14 can have circuit board traces that route signals through solder tails 19, 19*a*, 19*b*, 19*c* and 19*d* to the connector contacts in the housing module.

The connector can also be mounted directly to a stand-alone electronic printed circuit board or motherboard 21 without an IPCB 14. The other half 22 of the connector accepts the extruded housing 11 in a single or stackable modular configuration 15 having the same center spacing of two mm or less. Each half of the mating connector has a contact pin 13 through 13*d* and 23 through 23*d*. The contact pins of each half make contact in a cantilever fashion (displacing each pin along its length thus making electrical contact). The contact of the mating connector pins is made inside the extruded connector-housing module 11. Thus, the enclosed mating contact pins are inside the connector-housing cavity providing a four sided metal enclosure along the length of the mating pins. Traditionally, connector housings are often injection molded from plastics and fit with a metal shield or metal stiffeners in an attempt to achieve a partially shielded enclosure.

The extruded housing 11, however, provides a four-sided metal enclosure for each contact along the length of the contact in the rectangular multiple contact connector on contact centers of 2 mm or less. This housing 11 (also referred to herein as "contiguous metal shield" and "contiguous metal housing" is grounded through the intermediate printed circuit board 14 using contact tension points 16 and 16*a*, In this manner, shielded contact density is higher in the extruded module for each individual contacts then the previously referenced patents. For example, in each of the previously referenced patents signal density of each housing module is limited by its spacing to the adjacent contact surrounded by an injection molded material in the multiple connector modules. U.S. Pat. Nos. 5,176,538 and 4,655,518 make some adjustment for the shield limitation by optionally grounding adjacent pins 13 through 13*d* between the signal pins. In this manner, each signal pin may have an adjacent ground pin. In addition the previously referenced patents have one outside face on two sides of each module shielded by attaching a metal plate versus the four sides of the present invention. The insulation between contacts in the aforementioned approaches is injection-molded material. Thus the signal or ground pins do not have a contiguous metal enclosure on all four sides. Shielded signal density, in the above-referenced patents, is limited by the need for adjacent ground pins or the mechanical construction of each connector module. This is also true when the mating halves of these connectors are joined. Thus the (i.e., the number signal pins divided by the total number of signal and ground pins) in a five-row connector with the extreme outside pins and middle pin forming a ground shield for the signal contacts, there are only two signal remaining signal contact pins. Furthermore, there is limited contact shielding in the connector module. In the previously referenced patents, each individual contact does not have a metal enclosure. Rather, the entire connector module contains a plurality of contacts and metal plates covering three sides of the outside housing. The extruded connector housing module 11 provides channels 12 through

12*d* that enclose each individual metal contacts 13 through 13*d* in a contiguous metal shield 11 along the length of each contact.

The method of producing an extruded metallic electrical connector assembly 30 comprising the steps of extruding a continuous metal housing having a plurality of channels positioned therein 31; cutting said housing to the desired length 32; coating the inside of said channels of said metal housing with an insulation material 33; installing the mating guides 34; installing the printed circuit board into said housing 35; terminating cable to the printed circuit board assembly 36 and electrically connecting the assembly to the housing 37 therby forming a cable assembly 40.

All the previously referenced patents do provide some level of signal integrity by a combination of metal plates, stiffeners and plastic parts. However, a solid contiguous extruded metal housing having a plurality of channels provides a true four-sided metal enclosure for each signal contact. The extruded connector construction offers a lower inductance and resistance as well as contiguous wrap-around shielding than non-contiguous fitted parts joined by injection molding, press-fitting, stamping, riveting or crimping.

While I have described my invention in connection with specific embodiments thereof, it is clearly to be understood that this is done only by way of example and not as a limitation to the scope of our invention as set forth in the objects thereof and in the appended claims.

What is claimed is:

1. An electrical connector assembly, for use in situations requiring electrical connection via a plurality of electrical contacts, comprising:

an extruded metal housing having a plurality of rectangular cross-section channels formed therein during extrusion and having an insulating coating formed on the inside thereof;

the electrical contacts being positionable within respective said channels so as to be completely shielded on four sides;

mating guides positioned at one end of said extruded metal housing for guiding said electrical contacts into said channels;

at least one intermediate printed circuit board having receiving slots positioned therein for receiving each of said electrial contacts on one end and means for connecting an electrical cable on the other end;

said at least one intermediate printed circuit board further having grounding points attached thereto for providing a ground for said extruded metal housing; and means for supporting and positioning said electrical contacts.

2. An extruded metallic electrical connector assembly, according to claim 1, wherein:

said channels being spaced apart on-center by two millimeters or less so as to accommodate electrical contacts having a corresponding spacing.

3. An extruded metallic electrical connector assembly, according to claim 1, wherein:

said extruded metallic housing has a rectangular cross-section and is stackable.

4. An extruded metallic electrical connector assembly, according to claim 1, wherein:

said coating includes a dielectric suitable for supporting signal transmission within said electrical contacts.

5. An extruded metallic electrical connector assembly, for use in situations requiring electrical connection via a plurality of electrical contacts, comprising:

an extruded metal housing having at least one channel formed therein during extrusion of said extruded metal housing and adapted for receiving corresponding electrical contacts such that the electrical contacts are completely shielded along their length;

mating guides positioned at one end of said extruded metal housing for guiding the electrical conductors into said channels;

at least one electronic printed circuit board having receiving slots positioned therein on one end for receiving each of said plurality of conductors and, on the other end, is mounted to said circuit board;

said electronic printed circuit board further having grounding points attached thereto so as to provide a ground for the conductors; and means for supporting and positioning said electrical contacts.

6. A method of producing an extruded metallic electrical connector assembly for electrical connection via a plurality of electrical contacts, comprising the steps of:

extruding a contiguous metal housing having a plurality of channels formed therein;

cutting said metal housing to a desired length;

coating the inside of said channels with an insulation material;

installing mating guides at one end the metal housing adjacent the channels so as to guide the electrical contacts into respective channels;

electrically connecting a printed circuit board into the housing;

electrically connecting a cable to the printed circuit board at an end opposite the metal housing, thereby forming a printed circuit board assembly; and electrically connecting the printed circuit board assembly to the metal housing.

7. A method according to claim 6, including the step of forming said plurality of channels such that the channels are spaced apart by two millimeters or less as measured on-center from each channel in order to accommodate electrical contacts similarly spaced-apart.

* * * * *